US005417253A

United States Patent [19]

Kurmis

[11] Patent Number: 5,417,253

[45] Date of Patent: May 23, 1995

[54] TOOL FOR BINDING AN OBJECT BY MEANS OF A STRIP

[75] Inventor: Viktor Kurmis, Pinneberg, Germany

[73] Assignee: Bowthorpe plc, Crawley, England

[21] Appl. No.: 145,964

[22] Filed: Oct. 29, 1993

[30] Foreign Application Priority Data

Nov. 2, 1992 [DE] Germany ..... 9214901 U

[51] Int. Cl.[6] ..... B21F 9/02

[52] U.S. Cl. ..... 140/93.2; 140/93 A

[58] Field of Search ..... 140/93 A, 93.2, 123.5, 140/123.6

[56] References Cited

U.S. PATENT DOCUMENTS 3,946,769 3/1976 Caveney et al. ..... 140/93.2
3,976,108 8/1976 Caveney et al. ..... 140/93 A
4,178,973 12/1979 Collier et al. ..... 140/123.6
5,042,535 8/1991 Schlottke ..... 140/93 A

FOREIGN PATENT DOCUMENTS

0390434A1 3/1990 European Pat. Off. .
2401742 9/1978 France .
8913511 U 4/1991 Germany .

*Primary Examiner*—Lowell A. Larson
*Attorney, Agent, or Firm*—Chilton, Alix & Van Kirk

[57] ABSTRACT

Tool for binding an object by means of a strip which, consists of a strip tongue and a lock which is firmly connected to one end of the strip tongue and has a strip opening for retaining the other end of the strip tongue. The tool comprises a binding device and a retaining device and, for guiding the strip from the strip retaining device to the binding device, a guide channel with which an elongated, flexible slide interacts which is guided via a drive roller which is provided at the end of the guide channel remote from the binding device. According to the invention, the elongated, flexible slide, or a part of the same, is formed by a flat slide strip, consisting especially of metal, which is broader than the guide channel at least in parts of its length, guide grooves being provided in the side walls of the guide channel for receiving the edges of the slide strip.

8 Claims, 2 Drawing Sheets

TOOL FOR BINDING AN OBJECT BY MEANS OF A STRIP

The invention relates to a tool for binding an object by means of a strip, which consists of a strip tongue and a lock which is firmly connected to one end of the strip tongue and has a strip opening for retaining the other end of the strip tongue. The tool comprises a binding device and a strip retaining device and, for guiding the strip from the strip retaining device to the binding device, a guide channel with which an elongated, flexible slide interacts which is guided on the end of the guide channel remote from the binding device via a drive roller.

In a known tool of this type (DE-U 8,913,511), the elongated flexible slide is a flexible rod (for example a worm spring) which is guided by the channel surface in the same way as the strip which is to be pushed through the guide channel. This can result in difficulties if the guide channel has a large lateral dimension, as is the case if the strip lock has a large lateral dimension for example because it is equipped with a special attachment part which projects at right angles to the longitudinal direction of the guide channel.

The invention provides for such a case, in which the slide is formed by a flat strip, consisting especially of metal, which is broader than the guide channel at least in parts of its length, guide grooves being provided in the side walls of the guide channel for retaining the edges of this slide strip.

In consequence, the slide or its elongated flexible part is provided with a guide which is separate from the other shape and function of the guide channel. During forming of the guide channel, there is thus no need to take any account of the slide, and vice versa.

The drive roller for the slide is designed as a toothed roller or friction roller in one embodiment of the invention. In this case, a special magazine is provided for retaining the part of the slide strip located behind the drive roller. This can be formed simply by an empty space. However, a roller is expediently provided for this purpose on whose circumference the slide strip can be wound. Such a roller can also be used for driving the slide strip. Especially in this case, the strip should rest firmly on the circumference of the drive roller, which is achieved, for example, by means of suitable compression rollers which are distributed over the circumference. A configuration in which the slide strip is of sprung construction and is provided with such pretensioning that it is pressed onto the circumference of the roller by this pretensioning is simpler and, therefore, often more expedient.

Pretensioning of the strip in the magazine can be used to support the drive, in that the slide strip of sprung construction is provided with pretensioning which tries to unwind it in the rolled-up state and/or to wind it up in the unrolled state. This simplifies the starting of the drive motor and speeds up the switching function to be carried out by it.

Figure 1:
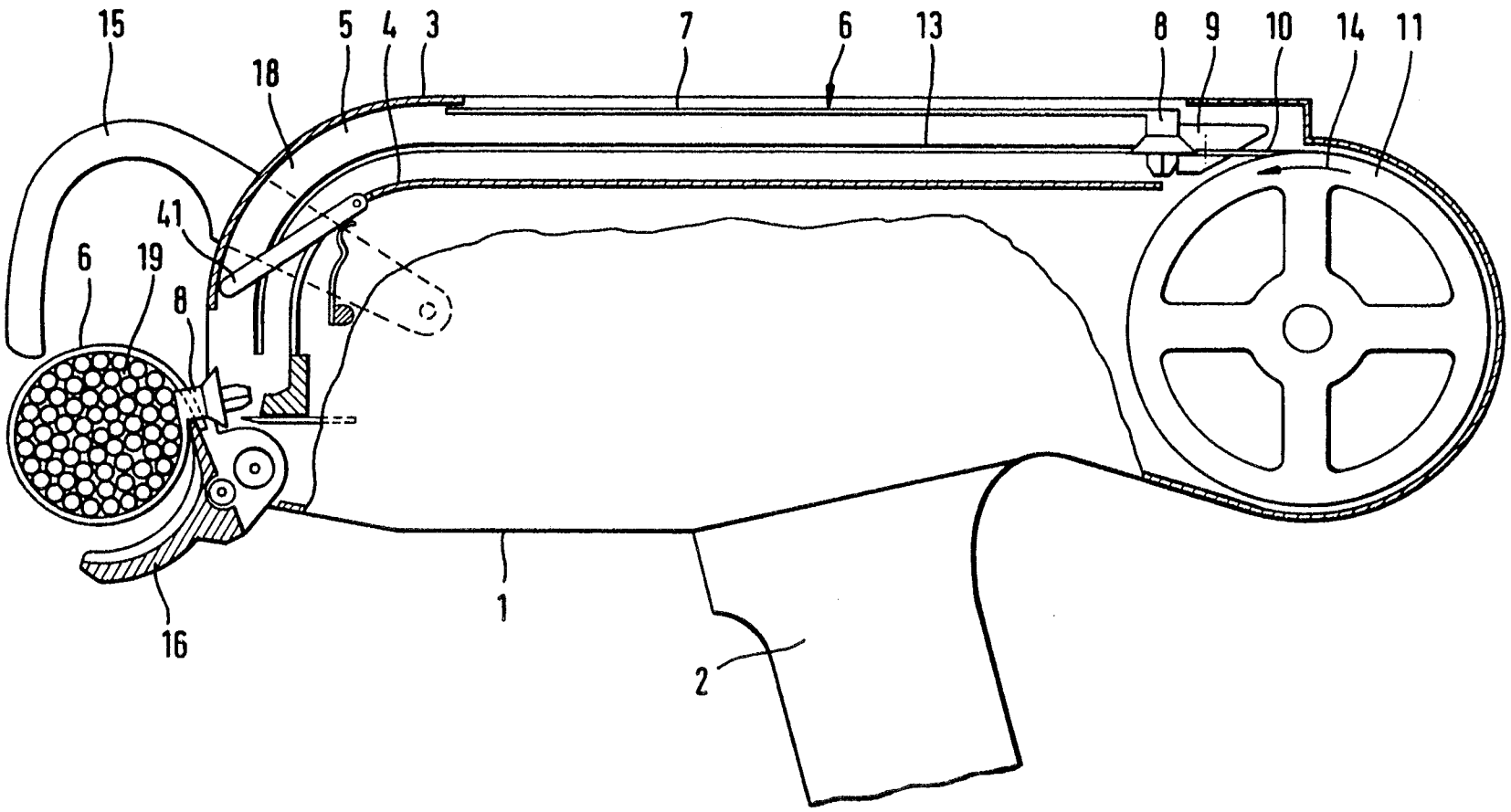
Figure 3:
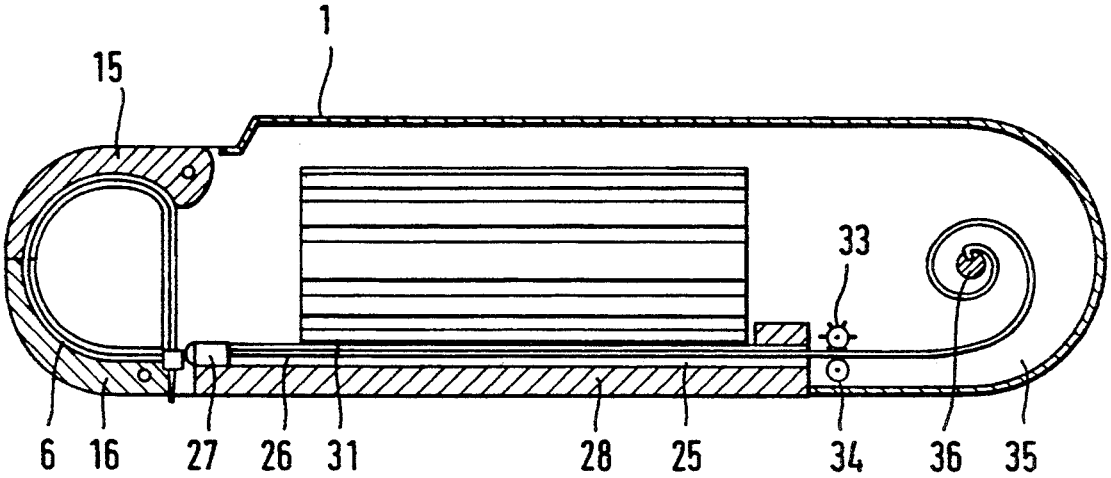
Figure 4:
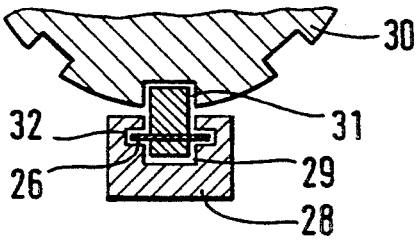

The invention is explained in more detail in the following text, making reference to the drawings which show two advantageous exemplary embodiments of the invention, and in which: FIG. 1 shows a longitudinal section through a first embodiment, FIG. 2 shows a cross-section through the guide channel of the first embodiment, FIG. 3 shows a second embodiment, and FIG. 4 shows a cross-section through the guide channel belonging to the second embodiment.

The tool according to FIG. 1 has a tool body 1 and a handle 2 by which said tool can be held. A guide channel 5 for a strip 6 consisting of viscoelastic synthetic material, such as polyamide, is located between the walls 3 and 4 of the housing body 1. Said strip 6 passes in any desired manner into the position inside the channel 5 which is shown in FIG. 1, for example using automatic means, which are not shown, from a strip magazine, or by hand. The strip has a strip tongue 7 and a head 8, the tip of the strip tongue pointing towards the front end of the tool body, which is shown on the left in FIG. 1, while the head 8 is located at the rear. Located behind the lock 8 in the guide channel 5 is a slide head 9 whose end, which interacts with the lock 8, is matched to the shape of the lock 8, and which is attached to the front end of a flexible steel strip 10 which is wound on a roll 11. The head 9 and the steel strip 10 together form a slide for pushing the strip 6 out of the position shown in FIG. 1 to the left.

The devices 15, 16 for looping the strip 6 around the object 19 which is to be bound are located on the left-hand end surface of the tool. The channel 5 therefore leads via the bend 18, in which the channel direction turns through 90°, to the looping and binding devices. In order that the strip tongue reaches these devices correctly, a special guide device is provided. To be precise, the last section of the guide channel 5 contains a rocker arm 41 which presses the forward-running strip tongue under spring force against the wall 3 of the channel and in consequence gives it a direction which is required for correct insertion into the looping device.

Figure 2:
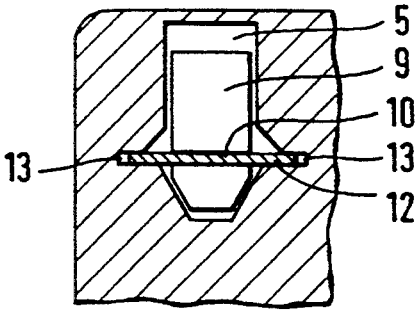

As can be seen from the cross-sectional representation in FIG. 2, the channel 5 has a large cross-section whose shape is matched to the cross-sectional design of the lock 8. In order nevertheless to give accurate guidance to the steel strip 10 in this wide space, grooves 13 are provided in the side surfaces of the channel 5, the common width and thickness of which grooves correspond, with the necessary running clearance, to the cross-sectional dimensions of the steel strip 10. They retain the edges 12 of the steel strip and consequently ensure exact positioning of the slide head 9 and the steel strip 10 over the entire length of the guide channel 5, especially including the curved region 18, as far as the looping and binding devices.

In its drawn-back quiescent position, as is shown in FIG. 1, the steel strip 10 is held by the circumference of the roll 11. This roll also forms the drive means for the slide.

If the roll 11 is rotated in the arrow direction 14, the steel strip 10 is pushed forwards with the slide head 9, along the guide channel 5. In order that the steel strip 10 does not stick during this between the roll 11 and the housing wall surrounding the roll, it may have pretensioning which holds it on the circumference of the roll 11. By means of movement against the arrow direction 14, the slide which is formed by the strip 10 and the slide head 9 is drawn back into the original position shown. Drive and control means, which are of a conventional type and therefore require no description, are provided for driving and controlling the rotation of the roll 11.

In the configuration according to FIG. 3, the tool body 1 likewise has the looping devices indicated by the parts 15, 16 of the pliers on its end shown on the left. Therein, a strip 6 is shown in the looping-round position, before clamping and binding. As in the first example, it moves into the position by being pushed through the guide channel 25, parallel to the longitudinal direction of the tool. This is done by means of the slide which consists of the steel strip 26 and the slide head 27. In this case, the guide channel 25 is partially formed by a groove 29 which is constructed in the shaded housing part 28, and partially by a groove 31 which is provided in the magazine drum 30.

Guide grooves 32 for the edges of the steel strip 26 are provided in the side walls of the groove 29. In consequence, the steel strip itself is guided reliably, in the same way as the slide head 27 which is firmly connected to the steel strip, irrespective of whatever cross-sectional design the guide channel 29 may otherwise have.

The slide is fed by means of a toothed roller 33 which engages into a corresponding row of holes in the steel strip 26 by means of an opposing roller 34 being supported opposite to the toothed roller 33.

A retaining space 35 for the steel strip in its quiescent position is located behind the pair of rollers 33, 34. Said strip forms a spiral winding around the roller 36, which may be arranged stationary or such that it can rotate. Said strip consists of spring steel and is preformed in such a manner that, in the pushed-forward state shown, a force is exerted which tries to draw the slide back while, in the quiescent position, when the steel strip is virtually entirely located in the space 35, an elastic force is generated in the opposite direction. In consequence, the starting of the drive motor, which acts on the steel strip via the toothed roller 33, is speeded up, or the drive can be designed to be correspondingly weaker.

I claim:

1. Tool for binding an object by means of a strip (6), which consists of a strip tongue (7) and a lock (8) which is firmly connected to one end of the strip tongue and has a strip opening for retaining the other end of the strip tongue, the tool (1) having a binding device (15, 16), a strip retaining device, a guide channel for guiding the strip from the strip retaining device to the binding device, an elongated, flexible slide mounted in the end of the guide channel remote from the binding device for movement along the channel and a drive roller (11, 33) for driving the slide, characterised in that the slide includes an elongated, flexible part formed by a flat slide strip (10, 26), the guide channel (5) having guide grooves (13, 32) in the side walls thereof, said slide strip having longitudinally extending edges and being of sufficient breadth for retaining the edges (12) of the slide strip in the guide grooves.

2. Tool according to claim 1, characterised in that the strip retaining device includes a magazine (11, 35, 36) for retaining the rear end of the slide strip.

3. Tool according to claim 2, characterised in that the magazine comprises a roller (36) around which the slide strip (26) can be wound.

4. Tool according to claim 1, characterised in that the slide strip (10) is wound on the circumference of the drive roller (11).

5. Tool according to claim 1, characterised in that the slide strip (10, 26) is of spring construction and is pretensioned to unwind in the rolled-up state or to wind in the unrolled state.

6. Tool according to claim 1, characterised in that the slide strip consists of spring metal and is pretensioned to be retained on the circumference of a roller (11, 36) positioned remote from the binding device.

7. Tool according to claim 1, characterised in that the drive roller is a toothed roller.

8. Tool according to claim 1, characterised in that the drive roller is a friction roller.

* * * * *